US010131464B2

(12) United States Patent
Tamaro et al.

(10) Patent No.: US 10,131,464 B2
(45) Date of Patent: Nov. 20, 2018

(54) CONTAINER FOR FOODSTUFFS, IN PARTICULAR COFFEE

(71) Applicant: ILLYCAFFE' SPA CON UNICO SOCIO, Trieste (IT)

(72) Inventors: Walter Tamaro, Trieste (IT); Giulio Gerbino, Trieste (IT)

(73) Assignee: ILLYCAFFE' SPA CON UNICO SOCIO, Trieste (IT)

( * ) Notice: Subject to any disclaimer, the term of this patent is extended or adjusted under 35 U.S.C. 154(b) by 0 days.

(21) Appl. No.: 14/400,290

(22) PCT Filed: May 10, 2013

(86) PCT No.: PCT/IB2013/000895
§ 371 (c)(1),
(2) Date: Nov. 10, 2014

(87) PCT Pub. No.: WO2013/167957
PCT Pub. Date: Nov. 14, 2013

(65) Prior Publication Data

US 2015/0122811 A1 May 7, 2015

(30) Foreign Application Priority Data

May 11, 2012 (IT) ..... UD2012A0087

(51) Int. Cl.
*B65D 21/02* (2006.01)
*B65D 25/18* (2006.01)
*B65D 77/06* (2006.01)
*B65D 43/02* (2006.01)

(52) U.S. Cl.
CPC ..... *B65D 21/0233* (2013.01); *B65D 25/18* (2013.01); *B65D 43/0212* (2013.01);
(Continued)

(58) Field of Classification Search
CPC ..... B65D 77/06; B65D 77/04; B65D 77/048; B65D 77/0486; B65D 21/0233
(Continued)

(56) References Cited

U.S. PATENT DOCUMENTS 4,459,793 A * 7/1984 Zenger ..... B65D 25/18 220/495.04
4,925,055 A * 5/1990 Robbins, III ..... A61J 1/05 215/12.1
5,118,003 A 6/1992 Pepper et al.
6,007,779 A * 12/1999 Lemieux ..... B65D 71/70 206/499
(Continued)

FOREIGN PATENT DOCUMENTS

CH 362330 A 5/1962
DE 3 439 442 A1 4/1986
(Continued)

OTHER PUBLICATIONS

Search Report for PCT/IB2013/000895, dated Sep. 3, 2013.
Written Opinion for PCT/IB2013/000895, dated Sep. 3, 2014.

*Primary Examiner* — Robert Poon
(74) *Attorney, Agent, or Firm* — Marshall, Gerstein & Borun LLP

(57) ABSTRACT

A container for foodstuffs (10), in particular coffee, suitable to be used as a refill for a tin (20) having a peripheral wall (21) made of rigid material, which defines an internal compartment (22), comprises a central body (11) made of a flexible material and having external sizes substantially equal to, or a little smaller than, those of said internal compartment (22) of the tin (20). Coupling means (30) are provided to temporarily couple, in a removable manner, the central body (11) with the tin (20).

1 Claim, 7 Drawing Sheets

(52) U.S. Cl.
CPC ..... *B65D 77/06* (2013.01); *B65D 2543/0062* (2013.01); *B65D 2543/00092* (2013.01); *B65D 2543/00537* (2013.01); *B65D 2543/00731* (2013.01)

(58) Field of Classification Search
USPC ..... 220/23.89, 528, 23.87, 495.03, 23.86, 220/573.4, 574.3, 592.15, 573.5, 592.23, 220/592.27; 206/499, 505
See application file for complete search history.

(56) References Cited

U.S. PATENT DOCUMENTS

| | | | | |
|---|---|---|---|---|
| 6,085,927 | A | 7/2000 | Kusz | |
| 8,070,007 | B2 * | 12/2011 | Ho | A47J 47/01 220/23.89 |
| 8,448,788 | B2 * | 5/2013 | Krasznai | A47J 43/0727 206/499 |
| 9,150,347 | B2 * | 10/2015 | Scheiber | B65D 85/8043 |
| 2009/0205504 | A1 * | 8/2009 | Navarro Alcantara | B65D 77/0486 99/295 |

FOREIGN PATENT DOCUMENTS

| | | | |
|---|---|---|---|
| EP | 0 330 785 | A2 | 9/1989 |
| EP | 0 571 775 | A1 | 12/1993 |
| EP | 0 691 278 | A1 | 1/1996 |
| GB | 769332 | A | 3/1957 |
| GB | 2 151 593 | A | 7/1985 |

* cited by examiner

CONTAINER FOR FOODSTUFFS, IN PARTICULAR COFFEE

FIELD OF THE INVENTION

The present invention concerns a container for foodstuffs, in particular coffee, in grains or in powder form, comprising a refill container or refill, and a tin. The refill container according to the present invention, which hereafter shall be called refill container, is made of a very light and flexible material for foodstuffs, and is suitable to be inserted inside an empty tin made of a rigid material. Suitable coupling means are provided to temporarily couple the refill container and the tin with respect to each other.

BACKGROUND OF THE INVENTION

In the field of containers for domestic use to contain foodstuffs, in particular coffee, rigid tins are known, mostly made of metal, but also made of glass, pottery or non-toxic plastic material, provided with a hermetically closing lid. Normally the sizes of such tins are standardized and, in the case of coffee, can contain pre-established amounts, for example 125 g or 250 g, and are suitable above all to contain foodstuffs whose characteristics can deteriorate or worsen when in contact with the light or the air.

One disadvantage of these known tins is their high cost, above all due to the rigid material used, both to make the central body and to make the corresponding closing lid.

There is thus a need to make more economic containers, without compromising their optimal preservation capacity for the food contained therein.

Document EP 571.775 shows a square refill container suitable to be coupled to a can made of tin or metal which is generally also square in shape.

One purpose of the present invention is therefore to make a container for foodstuffs, in particular but not exclusively coffee, which can also act as a refill for an already existing rigid tin.

Another purpose of the present invention is to make a container for foodstuffs which can be temporarily coupled with the tin, simply but in any case stably and securely, with a long-lasting coupling, avoiding the risk of uncontrolled reciprocal movements which can cause accidental leakages of the product, without compromising the sealing characteristics of the tin.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a refill container according to the present invention is suitable to be inserted in a tin for foodstuffs, in particular coffee, having a peripheral wall made of rigid material, which defines an internal compartment which is open at the top, suitable to be closed by a lid, which can be the screwable or snap-in type.

The refill container and tin together define the container for foodstuffs according to the present invention.

In accordance with a main characteristic of the present invention, the refill container comprises a central body, made of flexible material and having external sizes substantially equal to or slightly smaller than those of the internal compartment of the tin; moreover, coupling means are provided to temporarily and removably couple the central body with the tin.

The coupling means can be of the snap-in type, or the bayonet type, or the tongue and groove type, or the interference type.

In particular, a preferential form of embodiment provides that the coupling means are made in the upper part of the refill container so as to cooperate, in abutment and/or interference and/or snap-in manner, with mating internal peripheral profiles of the tin.

In this way, when the tin made of rigid material is empty, because the foodstuff contained therein, for example coffee, has all been removed or used, instead of refilling the tin with more loose material, it is much more convenient and practical for the user to insert from above, into the internal compartment of the rigid tin, a refill container according to the present invention, which has been pre-packed and is full of coffee, or other foodstuff. Moreover, the refill container does not allow the powdered coffee contained therein to come into contact with the walls of the rigid tin, thus avoiding the risk of deterioration in the quality of the fresh coffee powder caused by rancid phenomena of the lipid fraction of the previous coffee powder that has remained on the walls of the rigid tin (so-called cross-contamination between two successive refills of loose coffee powder in the same rigid tin).

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF SOME PREFERENTIAL FORMS OF EMBODIMENT

Figure 1:
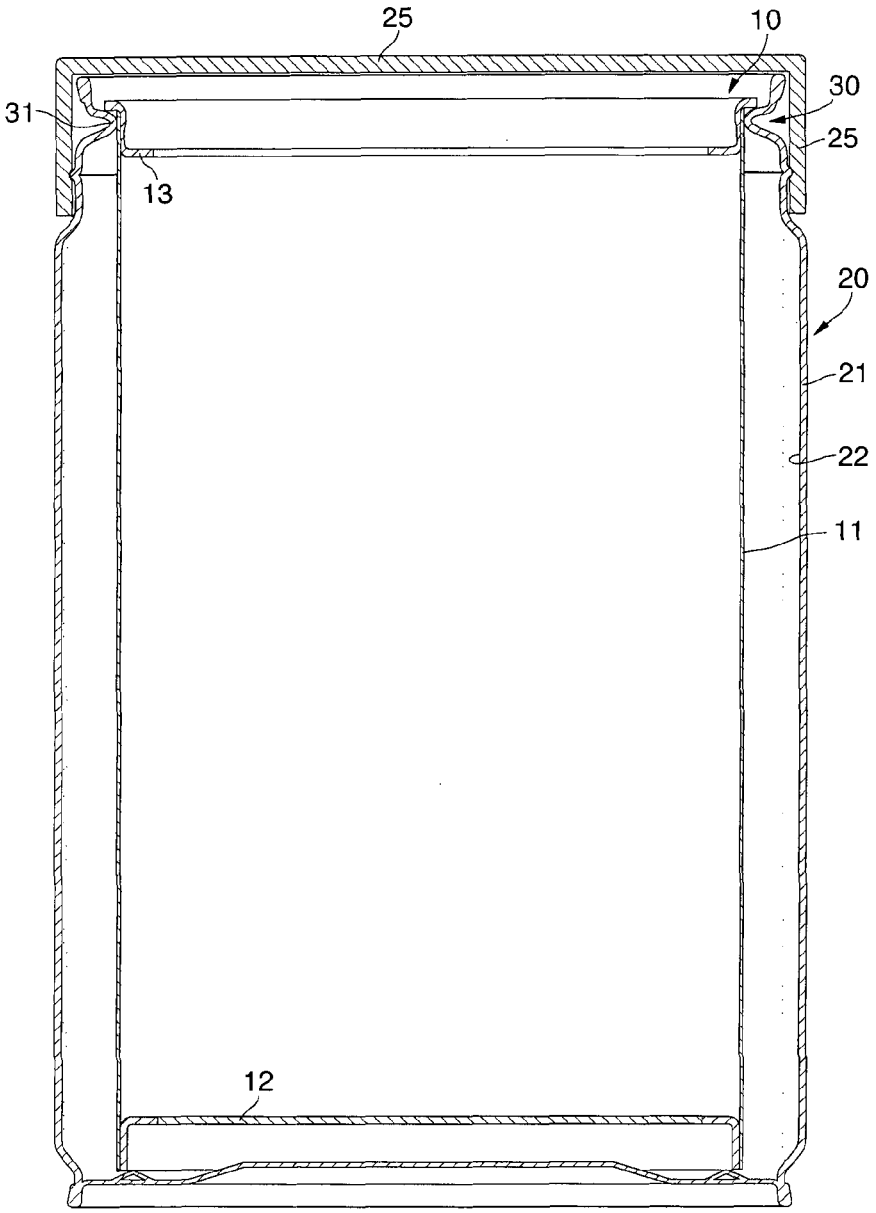
FIG. 1 is a longitudinal section of a refill container according to the present invention, inserted in a tin for foodstuffs.

With reference to FIG. 1, a refill container 10 according to the present invention comprises a central body 11, also called shell, of a substantially cylindrical shape and hollow inside, made of flexible material, for example of the multi-joined type with 4 layers, consisting of OPP, PET, Alu and PP.

A bottom 12 and an upper ring 13, both made of rigid material, are associated with the central body 11.

The sizes of the central body 11 are such as to render it easily insertable from above, into a tin 20, made of rigid material, for example tin, aluminum, or a non-toxic plastic material.

According to a particular example, the tin 20 is of the type marketed by the Applicant and comprises a metal peripheral wall 21, which defines an internal compartment 22 with a volume such as to contain about 250*g* of ground coffee. The upper part of the internal compartment 22 is suitable to be closed by a lid 25.

Coupling means 30, which will be described in detail hereafter, are able to ensure a stable but removable temporary coupling, of the refill container 10 and the tin 20.

In particular, in the form of embodiment shown in FIG. 1, the central body 11 of the refill container 10 has its external diameter equal to the internal diameter of an annular protuberance 31 of the tin 20, which protrudes, with an anti-cutting function, toward the internal compartment 22, so that the refill container 10, when it is inserted in the internal compartment 22 of the tin 20, remains well positioned inside it. In this case, the coupling means 30 consist of the same annular protuberance 31 which is suitable to cooperate with the external surface of the central body 11. The upper ring 13 of the refill container 10, which has a diameter greater than that of the central body 11, defines the vertical positioning of the latter in the internal compartment 22 of the tin 20.

Figure 2:
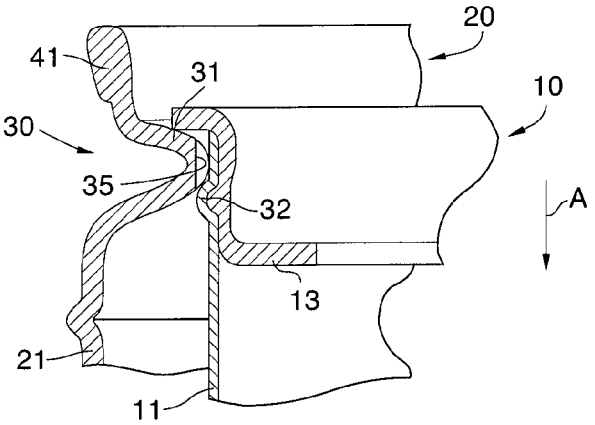
FIG. 2 is an enlarged detail, in longitudinal section, of a first variant of the container and the tin of FIG. 1.
Figure 3:
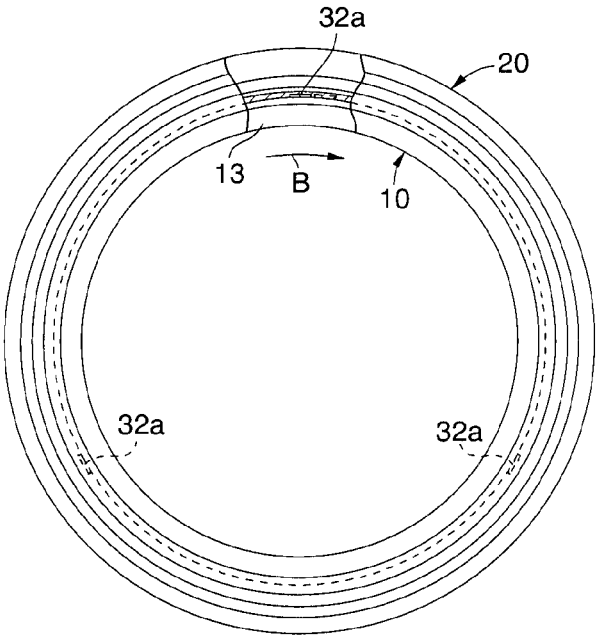
FIG. 3 is a view from above of the container and the tin of the first variant in FIG. 2.
Figure 4:
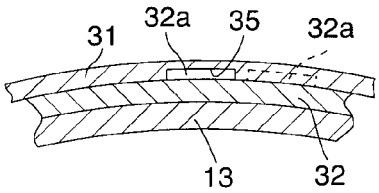
FIG. 4 is an enlarged detail of FIG. 2.

According to a first variant, shown in FIGS. 2, 3 and 4, in correspondence with a lateral shoulder of the upper ring 13, the refill container 10 is provided with an external rib 32, which can be continuous, that is annular, or made up of one or more segments 32*a* (FIGS. 3 and 4), obtained for example by molding. According to this first variant, the coupling means 30 consist of the annular protuberance 31 and the external rib 32, which are suitable to couple with each other through pressure. It is clear to a person of skill in the art that the sizes of the annular protuberance 31 and the external rib 32 must be such as to allow an easy insertion and an equally easy removal of the refill container 10 into and from the tin 20.

Alternatively, the segments 32*a* of the external rib 32 can be inserted into corresponding vertical slits 35 made in the protuberance 31 and can achieve a coupling of the so-called bayonet type, by means of a first axial insertion of the refill container 10 (arrow A in FIG. 2) and a subsequent partial rotation (arrow B in FIG. 3).

Figure 5:
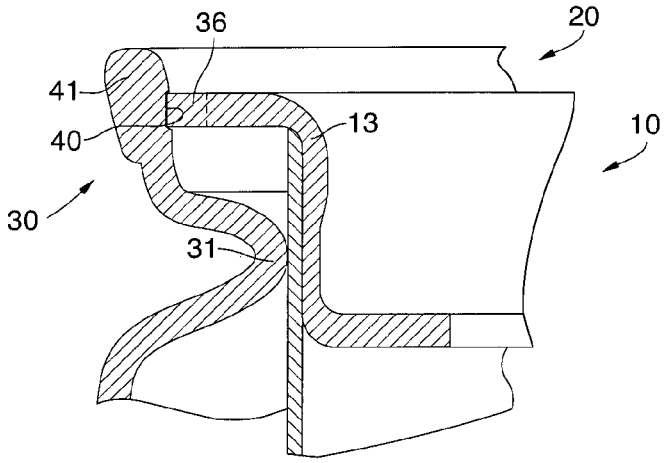
FIG. 5 is an enlarged detail, in longitudinal section, of a second variant of the container and the tin in FIG. 1.
Figure 6:
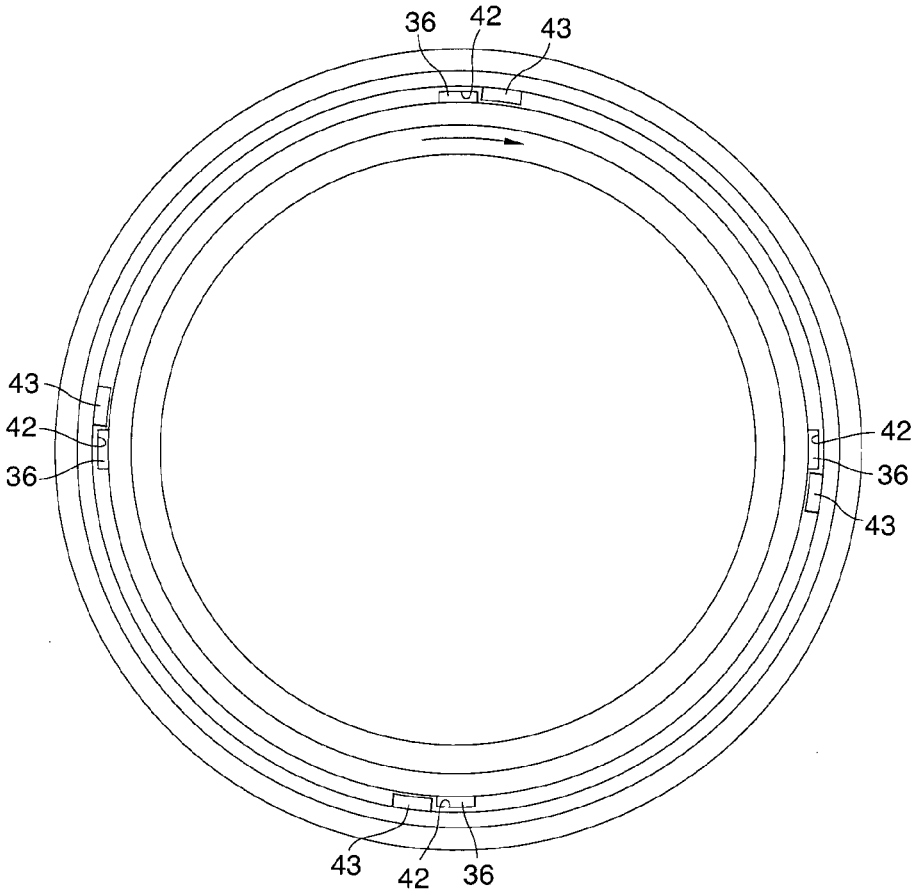
FIG. 6 is a view from above of the container and the tin of the second variant in FIG. 5.

According to a second variant, shown in FIGS. 5 and 6, the coupling of the refill container 10 and the tin 20 is achieved between an upper circular cavity 40 provided in the internal surface of a seam burr 41 present in the tin 20 and the peripheral edge of the upper ring 13 of the refill container 10.

For this second variant too, it is possible to provide an alternative in which the upper ring 13 is provided with one or more external protuberances 36 suitable to be inserted into corresponding vertical slits 42 made in the seam burr 41 and thus achieves another coupling of the bayonet type.

According to another alternative, each of the external protuberances 36 can cooperate, rather than with the vertical slits 42, with a corresponding fin 43 (FIG. 6) made in the internal part of the seam burr 41.

Figure 7:
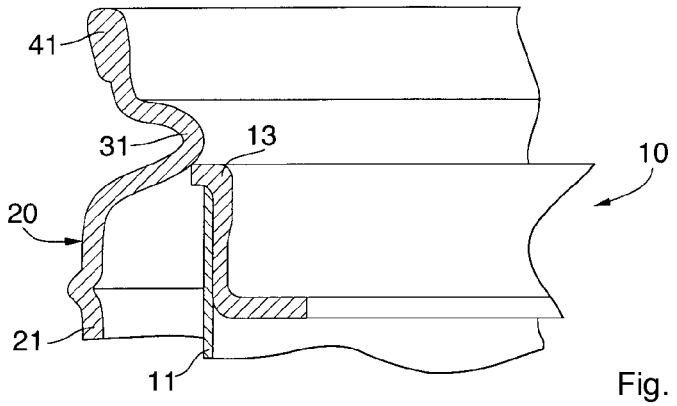
FIG. 7 is an enlarged detail, in longitudinal section, of a third variant of the container and the tin in FIG. 1.

According to a third variant, shown in FIG. 7, the coupling of the refill container 10 and the tin 20 is made by tongue and groove type fitting of the upper ring 13 of the refill container 10 on the annular protuberance 31. In this case the coupling of the refill container 10 and the tin 20 is achieved by simply pushing the former, from the top downward, with respect to the latter.

Figure 8:
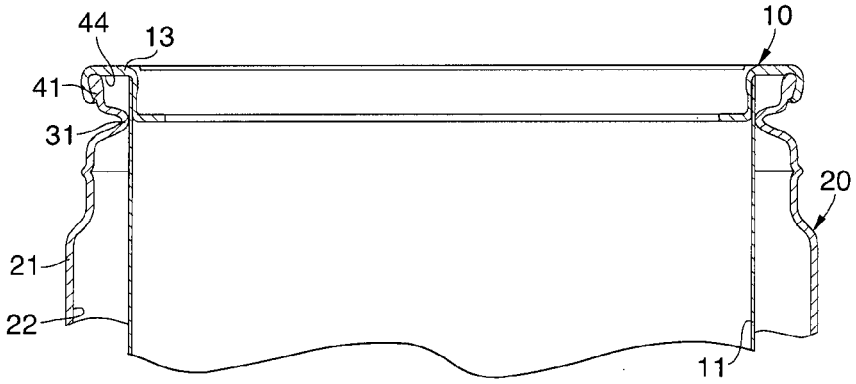
FIG. 8 is an enlarged detail, in longitudinal section, of a fourth variant of the container and the tin in FIG. 1.

According to a fourth variant, shown in FIG. 8, the coupling of the refill container 10 and the tin 20 is made by tongue and groove type fitting of the upper ring 13 of the refill container 10 on the seam burr 41. In this case the upper ring 13 has its peripheral edge bent downward and defines an annular groove 44.

Figure 9:
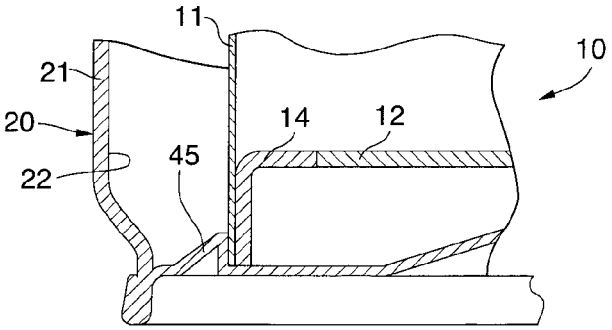
FIG. 9 is an enlarged detail, in longitudinal section, of a fifth variant of the container and the tin in FIG. 1.

According to a fifth variant, shown in FIG. 9, the coupling of the refill container 10 and the tin 20 is made by means of tongue and groove type fitting of a lower ring 14 of the refill container 10, associated to the bottom 12 of the latter, and a rib 45 made on the bottom of the tin 20, which can be either outside the lower ring 14 (FIG. 9), or inside it (not shown).

Figure 10:
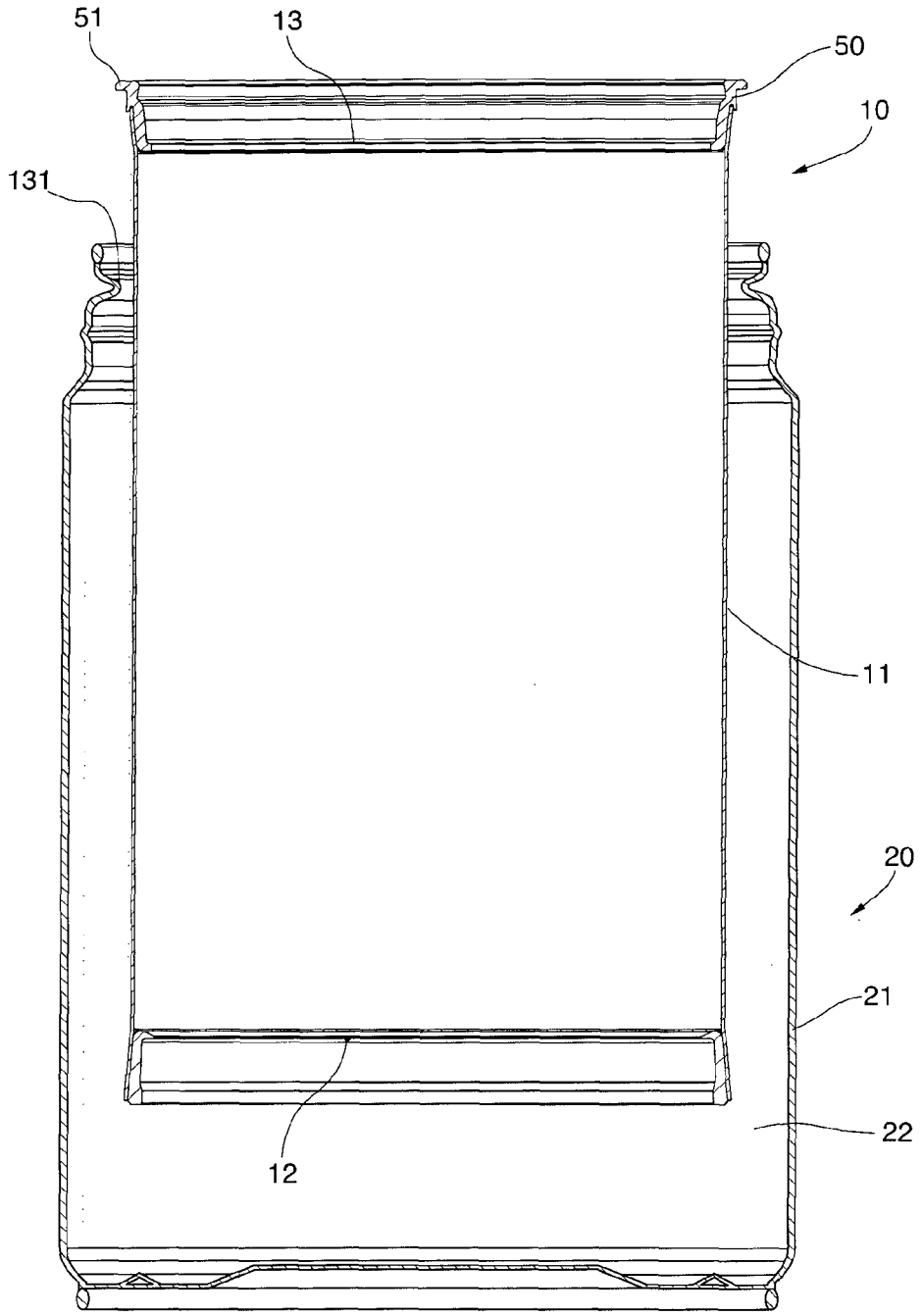
FIG. 10 is a longitudinal section of a refill container and a tin according to a variant of FIG. 1.
Figure 12:
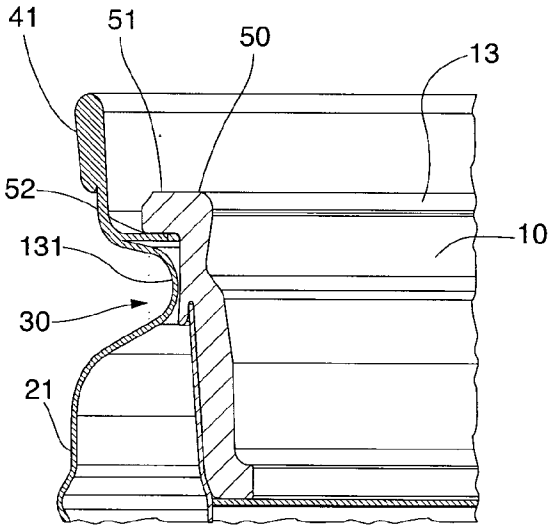
FIG. 12 shows an enlarged detail in section of the coupling zone between the upper edge of the refill container and tin in the form of embodiment of FIG. 10.
Figure 11:
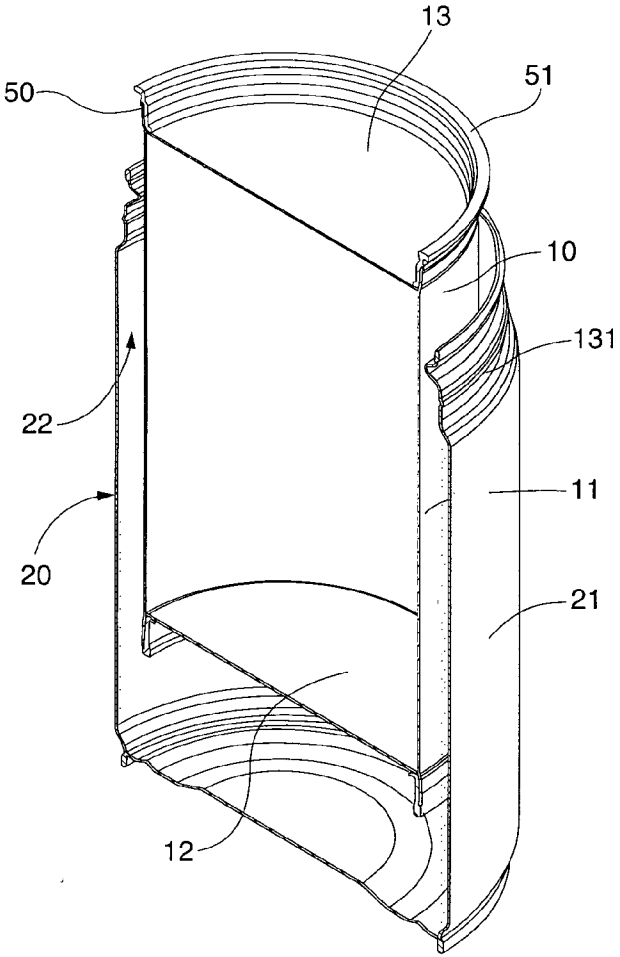
FIG. 11 shows a cut-away perspective view of the refill container and the tin in FIG. 10.

According to a further sixth variant, shown in FIGS. 10, 11 and 12, in which the same numbers refer to the same components already described in the previous forms of embodiment, the tin 20 has an annular protuberance 131 which protrudes toward the internal compartment 22. The annular protuberance 131 has an internal diameter which is greater than the external diameter of the central body 11 of the refill container 10, which can thus slide freely upward or downward inside the internal compartment 22, but which is equal to or even slightly smaller than an external diameter of a circular crown 50 provided in correspondence to the upper part of the refill container 10.

Therefore, as shown in FIG. 10, the insertion or extraction movement of the refill container 10 into or out of the tin 20 is free until (FIG. 12), the circular crown 50 provided at the top of the refill container 10 comes into interference contact with the protuberance 131. Moreover, as can be seen in FIG. 12, the tin 20 has a circular fin 52 facing toward the inside which defines an abutment for an annular shoulder 51 provided circumferentially in the upper ring 13.

Therefore, during the step when the refill container 10 is completely inserted inside the tin 20, there is first an interference travel when the circular crown 50 comes into contact and slightly presses against the internal edge of the annular protuberance 131. The refill container 10 can be inserted downward until the annular shoulder 51 abuts against the circular fin 52, so as to define a stable and precise position of the refill container 10 with respect to the tin 20.

The combination of the interference cooperation distributed over the whole circumference of the annular protuberance 131 and circular crown 50, and the positioning in abutment of the annular shoulder 50 against the circular fin 52 guarantees an extremely stable, accurate and secure positioning of the refill container 10 with respect to the tin 20.

In an advantageous form of embodiment the upper ring 13 of the refill container 10 is made of rigid plastic material, so as to further guarantee an optimal, stable and lasting positioning thanks to the interference with the annular protuberance 131 which, in the last insertion step, slightly deforms to allow the refill container 10 to be stably housed and positioned inside the tin 20.

Figure 13:
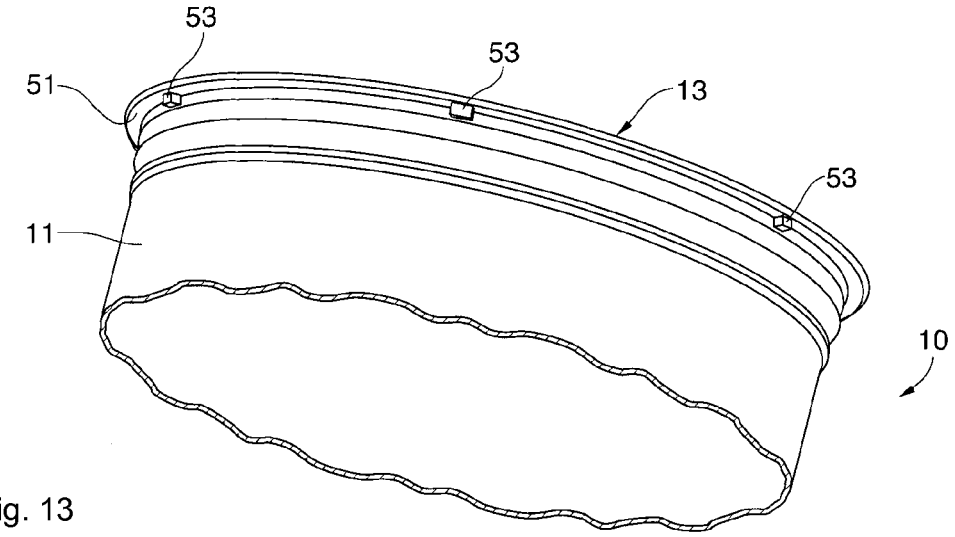
FIG. 13 shows the upper part of a refill container in another form of embodiment according to the present invention.
Figure 14:
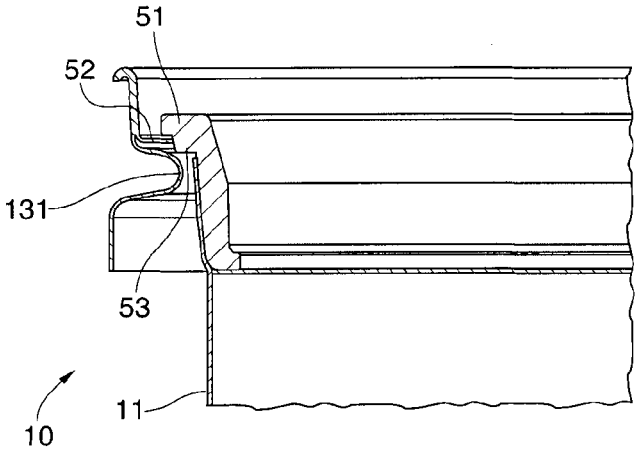
FIG. 14 shows an enlarged detail in section of the coupling zone between the upper edge of the refill container and tin in the form of embodiment of FIG. 13.

According to a seventh variant, shown in FIGS. 13 and 14, in which the same numbers refer to the same components already described in the previous forms of embodiment, the upper ring 13 also has, in this case, an annular shoulder 51, as in the previous solution, which defines the position of maximum insertion of the refill container 10 into the tin 20 when it goes into abutment against the upper surface of the circular fin 52. In this solution the upper ring 13 has, however, a plurality of gripping teeth 53, advantageously distributed uniformly over the entire circumference of the upper ring 13, in a position below the annular shoulder 51. The gripping teeth 53, cooperating with the inside edge of the circular ring 52, determine a clamping through interference of the refill container 10 with respect to the tin 20.

In this case too there is the double advantage of guaranteeing a stable and accurate position of maximum insertion guaranteed by the cooperation in abutment of annular shoulder 51 and circular fin 52, as well as a coupling by interference distributed over the entire circumference of the container 10 and the tin 20.

It is clear that modifications and/or additions of parts may be made to the refill container 10 as described heretofore, without departing from the field and scope of the present invention.

It is also clear that, although the present invention has been described with reference to some specific examples, a person of skill in the art shall certainly be able to achieve many other equivalent forms of refill container, having the characteristics as set forth in the claims and hence all coming within the field of protection defined thereby.

The invention claimed is:

1. Container for foodstuffs, comprising a refill container and a tin having a peripheral wall made of rigid material, which defines an internal compartment open at an upper part and a lid to close said internal compartment, said refill container comprising a central body made of flexible material and sized smaller than said internal compartment of said tin, and including a coupling assembly arranged to removably couple said central body to said tin, and wherein said coupling assembly is arranged in the upper part of the refill container so as to allow engagement between the upper part of the refill container and an internal perimeter profile of the tin;

and wherein the coupling assembly includes an annular protuberance formed by the tin and protruding toward said internal compartment, said annular protuberance having an internal diameter which is greater than the external diameter of said central body of said refill container, and wherein the internal diameter is equal to or smaller than an external diameter of a circular crown on the upper part of the refill container;

and further wherein the coupling assembly includes an inwardly facing circular fin formed by the tin, the fin being rigid and extending inwardly from above the annular protuberance, the circular fin defining an abutment positioned to engage an annular circumferential shoulder carried by an upper ring of said refill container when the central body of the refill container is coupled to the tin; and wherein the upper ring of said refill container has a plurality of gripping teeth distributed over a circumference of the upper ring in a position below the annular shoulder, the gripping teeth positioned to cooperate with an inside edge of the circular fin to form a clamping interference with the refill container with respect to the tin.

* * * * *